US007750227B2

(12) United States Patent
Hayes et al.

(10) Patent No.: US 7,750,227 B2
(45) **Date of Patent: *Jul. 6, 2010**

(54) APPLIANCE AUDIO NOTIFICATION DEVICE

(76) Inventors: Bobby Hayes, 518 Eastern Pkwy., Louisville, KY (US) 40217; John Rudolph, 816 Dresden Ct., Antioch, TN (US) 37013

( * ) Notice: Subject to any disclaimer, the term of this patent is extended or adjusted under 35 U.S.C. 154(b) by 0 days.

This patent is subject to a terminal disclaimer.

(21) Appl. No.: 12/209,510

(22) Filed: Sep. 12, 2008

(65) Prior Publication Data

US 2009/0000461 A1 Jan. 1, 2009

Related U.S. Application Data

(62) Division of application No. 11/074,612, filed on Mar. 8, 2005, now Pat. No. 7,439,439.

(60) Provisional application No. 60/551,553, filed on Mar. 9, 2004.

(51) Int. Cl.
*G10H 1/00* (2006.01)

(52) U.S. Cl. ..... 84/600

(58) Field of Classification Search ..... 84/600–602, 84/609, 615

See application file for complete search history.

(56) References Cited

U.S. PATENT DOCUMENTS 4,213,121 A 7/1980 Learn et al.
4,215,339 A 7/1980 Durkee
4,266,097 A * 5/1981 Cannon et al. ..... 379/102.05
4,526,478 A * 7/1985 Makuta ..... 368/273
4,697,932 A 10/1987 Matievic
4,924,747 A 5/1990 Lin
5,089,809 A 2/1992 Carmichael, Jr.
5,422,431 A 6/1995 Ichiki
5,586,174 A 12/1996 Bogner et al.
5,842,288 A 12/1998 Laseke et al.
5,987,105 A 11/1999 Jenkins et al.
6,018,290 A 1/2000 Vande Lune et al.
6,308,086 B1 * 10/2001 Yoshino ..... 455/567
6,400,821 B1 * 6/2002 Burgan et al. ..... 379/361
6,556,255 B1 * 4/2003 Kim et al. ..... 348/734
6,617,967 B2 9/2003 Baldwin et al.
7,486,173 B2 * 2/2009 Fisler ..... 340/384.73
2002/0095483 A1 * 7/2002 Lee et al. ..... 709/219
2003/0204376 A1 * 10/2003 Obata et al. ..... 702/188
2004/0189462 A1 * 9/2004 Eilers et al. ..... 340/531
2004/0263322 A1 * 12/2004 Onaru et al. ..... 340/384.7
2005/0086979 A1 * 4/2005 Son et al. ..... 68/3 R

* cited by examiner

*Primary Examiner*—Jeffrey Donels
(74) *Attorney, Agent, or Firm*—Pearne & Gordon LLP

(57) ABSTRACT

A flexible audio tone-generating device for use in a consumer appliance. The device generates pleasing musical tones. The device uses two outputs of a software-executing processor utilizing stored tone data associated with status events of the appliance to drive a tone circuit for outputting a melody using the tones to notify the user of the existence of one of the status events.

11 Claims, 7 Drawing Sheets

APPLIANCE AUDIO NOTIFICATION DEVICE

CROSS-REFERENCE TO RELATED APPLICATIONS

This application is a divisional of U.S. application Ser. No. 11/074,612, filed on Mar. 8, 2005 which claims the benefit of provisional application Ser. No. 60/551,553, filed on Mar. 9, 2004. These applications are incorporated herein by reference.

The disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all rights in the copyrighted material.

REFERENCE TO COMPUTER PROGRAM LISTING

A computer program listing appendix is included as part of this disclosure. The program listing consists of a Chime Code Module 1, and a Chime Code Module 2, attached hereto and incorporated herein.

BACKGROUND OF THE INVENTION

This application relates generally to an audio tone generating device.

More specifically, this application relates to a flexible audio tone generating device for use in a consumer appliance, the device capable of playing a melody having a pleasing, adjustable tone.

A typical beeper circuit used in an appliance is shown in FIG. 1. This circuit can utilize an oscillating square wave produced by a microprocessor and outputted to the AUDIO_WAV input. The audio signal begins abruptly when the oscillation begins and ends abruptly when the oscillation ends. This condition produces an abrupt "beep" or "buzz" that can be harsh, and is not necessarily pleasing to the ear.

Furthermore, voltage controlled amplifier circuits are also in use to generate audio tones. However, such circuits are relatively expensive. An alternative that utilizes existing appliance components and/or generates a pleasing audio tone at a lower cost would be beneficial.

SUMMARY OF THE INVENTION

Provided is a circuit for producing a pleasing audio signal, the circuit including a ramp and decay circuit that results in a graduated tone signal that is pleasing to hear.

Also provided is the above device capable of operating at multiple frequencies to provide additional distinct tones.

Further provided is a notification device for an appliance comprising: a microprocessor for executing a computer program for generating a first output signal and a second output signal; an electronic circuit for inputting the first output signal and for inputting the second output signal; and an output transducer connected to the electronic circuit for producing a musical notification sound for notifying a user of an appliance status.

The first output signal provides an oscillating signal to drive the electronic circuit to produce a musical note of the musical notification sound; and the second output signal provides a trigger signal to trigger and hold the musical note.

Also provided is an appliance utilizing the above described device.

Still further provided is a method for notifying a user of a status of an appliance comprising the steps of:

- storing a program in a memory;
- using a microprocessor to detect a status condition of the appliance;
- executing said program on the microprocessor, said executing including the steps of:
- retrieving melody data associated with the detected status condition;
- generating a first output signal of the microprocessor based on said retrieved melody data to provide an oscillating signal to a first output;
- generating a second output signal of the microprocessor based on said retrieved melody data to provide a trigger signal to a second output;
- providing said first output to a first input of an electronic circuit;
- providing said second output to a second input of said electronic circuit; and
- using an output transducer of said electronic circuit to generate a musical melody based on said retrieved melody data for notifying the user of the detected status of the appliance.

DETAILED DESCRIPTION OF THE CURRENT EMBODIMENTS

The invention is a flexible, adjustable circuit for generating an audio signal for providing an indication to a user, such as might be utilized by a consumer appliance to indicated a status of the appliance.

Figure 4:
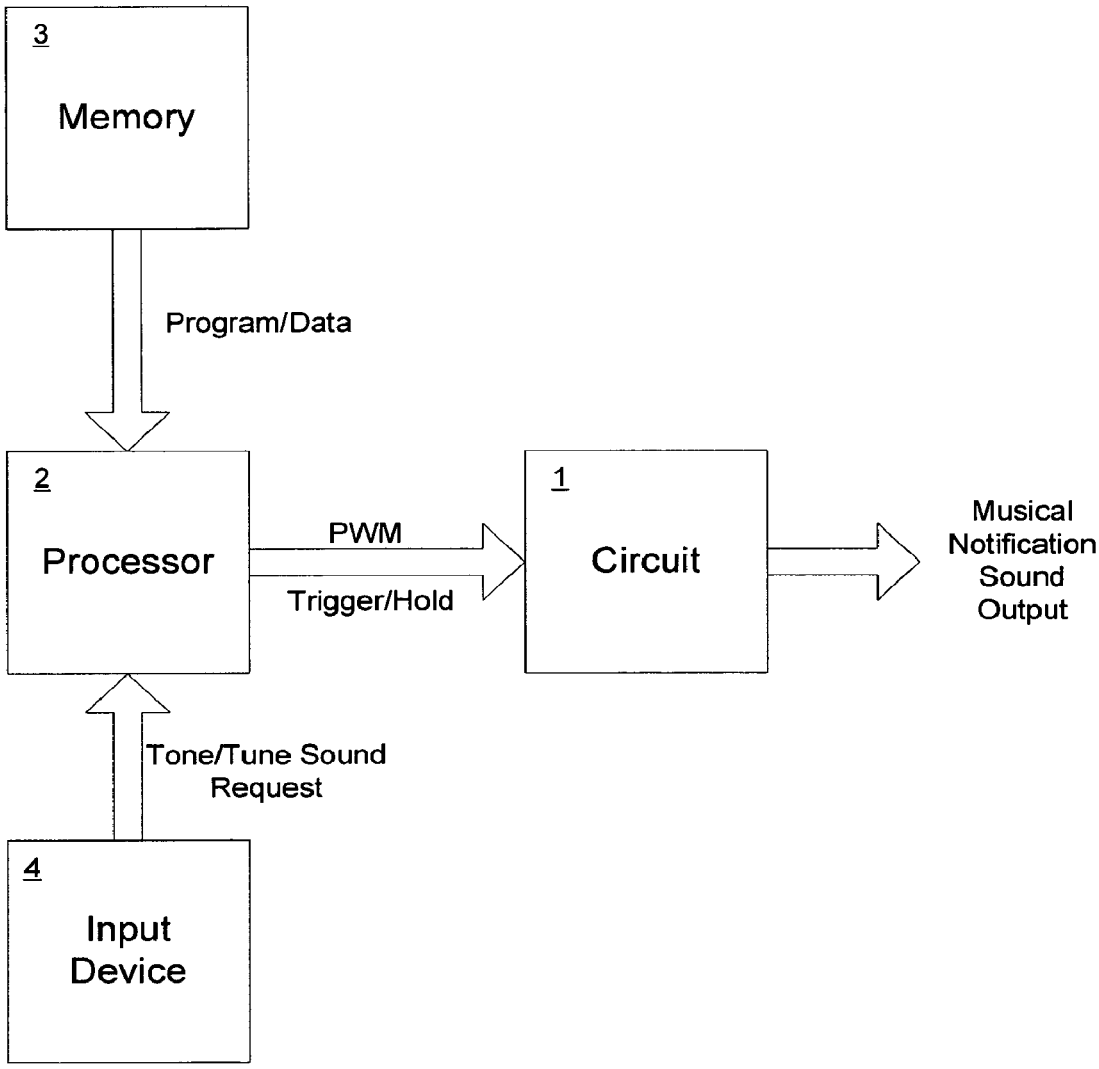
FIG. 4 shows a block diagram of the major components of the invention.

FIG. 4 is a block diagram of the major hardware components of the device. A tone-generating circuit 1 for generating a musical notification output, such as a musical melody, is provided. The circuit 1 receives inputs from a microprocessor 2, the inputs in the current embodiment being a pulse width modulated (PWM) signal and a trigger/hold signal. The microprocessor 2 executes one or more programs stored in memory 3. Memory 3 may also store data used in executing the program, as in the current embodiment. Finally, an input device 4 is used to indicate appliance status to request the various tones or melodies for outputting from the device by providing an input to the processor 2. The processor 2 could be a dedicated processor for use solely by the audio notification device, but more likely will be a shared processor also used for performing various other functions for the consumer appliance. In that case, the memory 3 may also store additional programs and/or data to support those additional functions, and the processor 2 may have additional inputs and/or outputs to support those functions as well.

Appliances that may use the device include stoves and ovens (i.e., consumer ranges), washers, dryers, refrigerators, and/or any other appliance or machine that could utilize a musical tone notification device.

Figure 1:
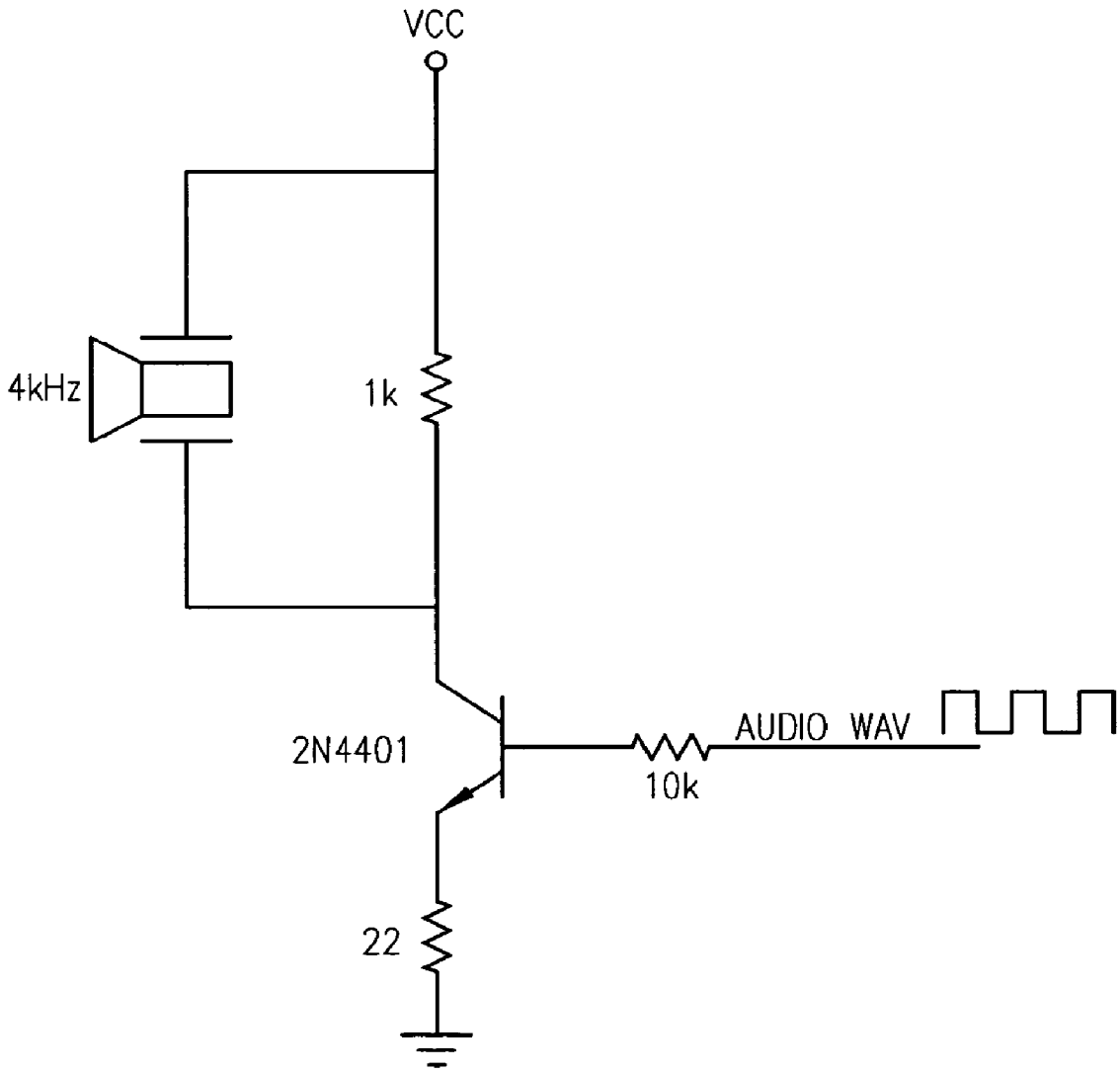
PRIOR ART Fig. 1
FIG. 1 shows a schematic of a conventional audio tone circuit.
Figure 2:
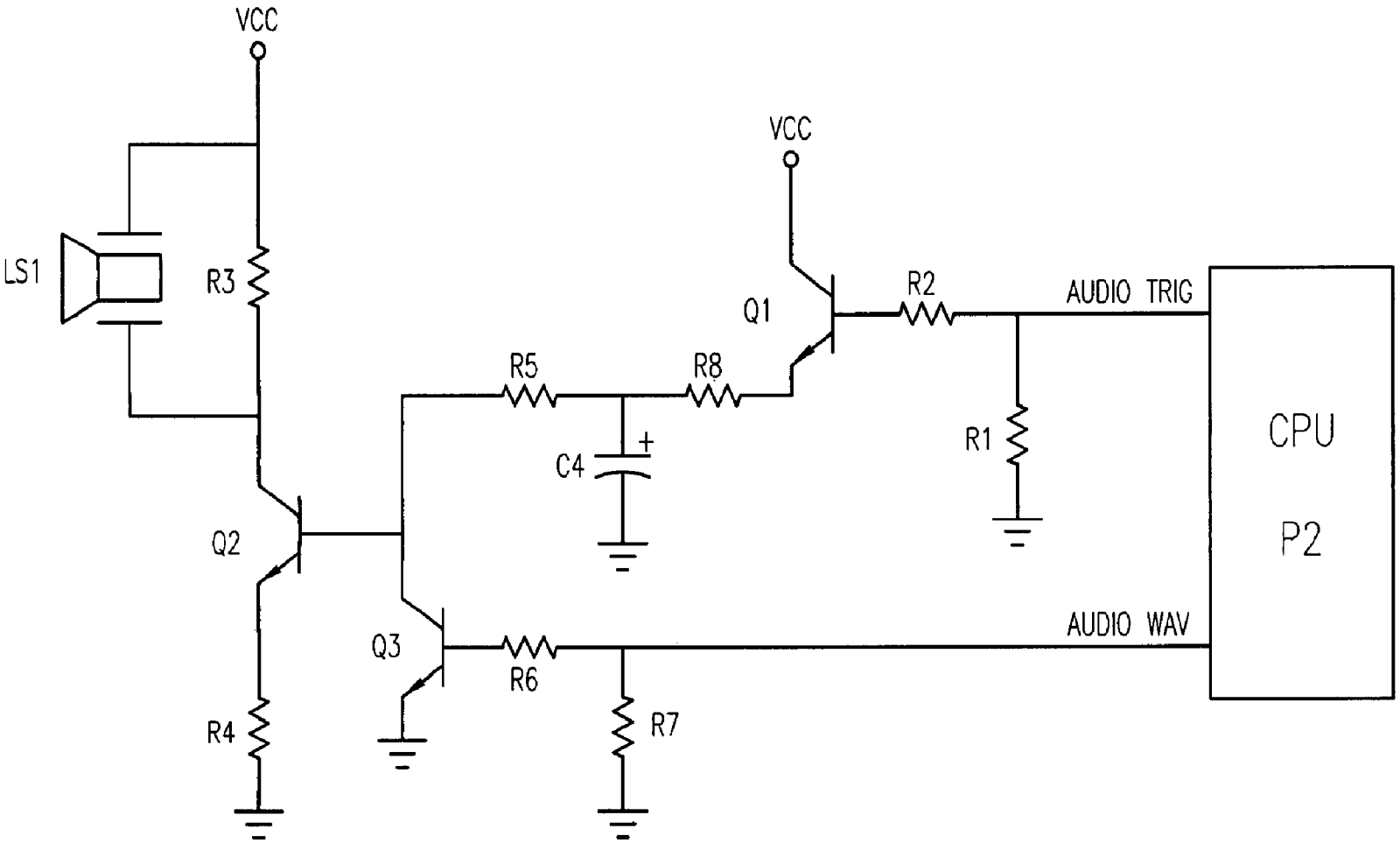
FIG. 2 shows a schematic of a circuit of hardware implementing one embodiment of the invention.

FIG. 2 provides a circuit for one embodiment of the tone-generating circuit 1 of the invention. In the circuit shown by this figure, the audio waveform is produced by the microprocessor P2 output is input to the AUDIO_WAV input of the circuit. In this embodiment, the microprocessor output is a PWM signal. However, the input oscillations are gated by another microprocessor output, a trigger/hold signal, input to the AUDIO_TRIG input. This trigger/hold signal then charges and discharges a capacitor (C4) via transistor Q1, which thus regulates the volume and duration of the oscillations permeated through the speaker.

The charge time of the capacitor will cause a ramp-up in volume when AUDIO_TRIG goes high. This can be referred to as the "attack" time of the waveform as it is in music synthesizers. The attack time is set by the capacitor C4 and the resistor R8 in the circuit of FIG. 2.

The discharge time of the capacitor will cause a ramp-down in volume when AUDIO TRIG goes low. This can be referred to as the "decay" time of the waveform as it is in music synthesizers. The decay time is set by selecting the values of the capacitor C4 and the resistor R5 in the circuit above. By varying such components in the circuit design, or providing a variable resistor and/or capacitor, the audio output attack and decay times can be modified or varied.

A "chime" is a waveform with a very quick attack time and a slow decay time. This is similar to when a person strikes a bell. The sound is heard at maximum volume instantly, and then it slowly decays until it is no longer heard. A chime sound can be produced by the circuit of FIG. 2 by shorting or using a small value for resistor R8 in the circuit.

Waveforms with slow attack and decay times are similar to what is heard from a violin. By setting resistor R8, capacitor C4 and resistor R5 correctly, a sound very similar to a violin can be produced with this circuit. For Example, setting R8=20 k, C4=47 uF, and R5=1 k can provide such a sound.

The circuit can also produce a waveform with a slow attack and quick decay. This kind of sound is not naturally occurring, and can only be produced via musical synthesizers. However, this capability gives the device the ability to create some unique sounding tones, if desired.

In the current embodiment of the circuit of FIG. 2, the circuit components take on the values given in the following table:

TABLE 1

| Component | Value |
|---|---|
| R1, R2, R6, R7 | 10 kΩ |
| R5, R8 | 4.7 kΩ |
| R3 | 1 kΩ |
| R4 | 22Ω |
| Q1, Q2, Q3 | 2N4404 |
| C4 | 22 μF |
| LS` | 4 kHz |

However, the values of these components can be varied to obtain the desired sound effects, especially resistor R8, capacitor C4 and resistor R5, as described above. Furthermore, equivalents of the other components can be used as substitutes for those shown in the table.

Figure 2A:
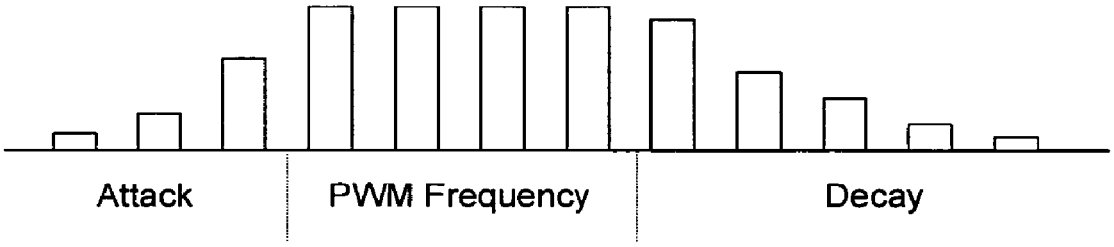
FIG. 2A shows a graphical plot of the output of the circuit according to FIG. 2 driven according to the invention.

FIG. 2A shows a plot of one example output of the circuit of FIG. 2 showing the attack, operating, and decay portions of the output. Varying R8, C4, and R5 can change the duration of the attack and decay portions, and the AUDIO_TRIG input can be used to control the duration of the middle (PWM) portion. The AUDIO_WAV PWM input, in contrast, controls the frequency of the outputted signal, and thus by varying the PWM frequency, the output signal frequency can also be varied.

By controlling the AUDIO_TRIG and AUDIO_WAV inputs, the circuit can be used to generate a plurality of pleasing melodies, each made up of a plurality of individual musical notes. The software routines of the Appendix are used to control the processor to produce the various melodies according to stored data for generating the various melodies.

Figure 3:
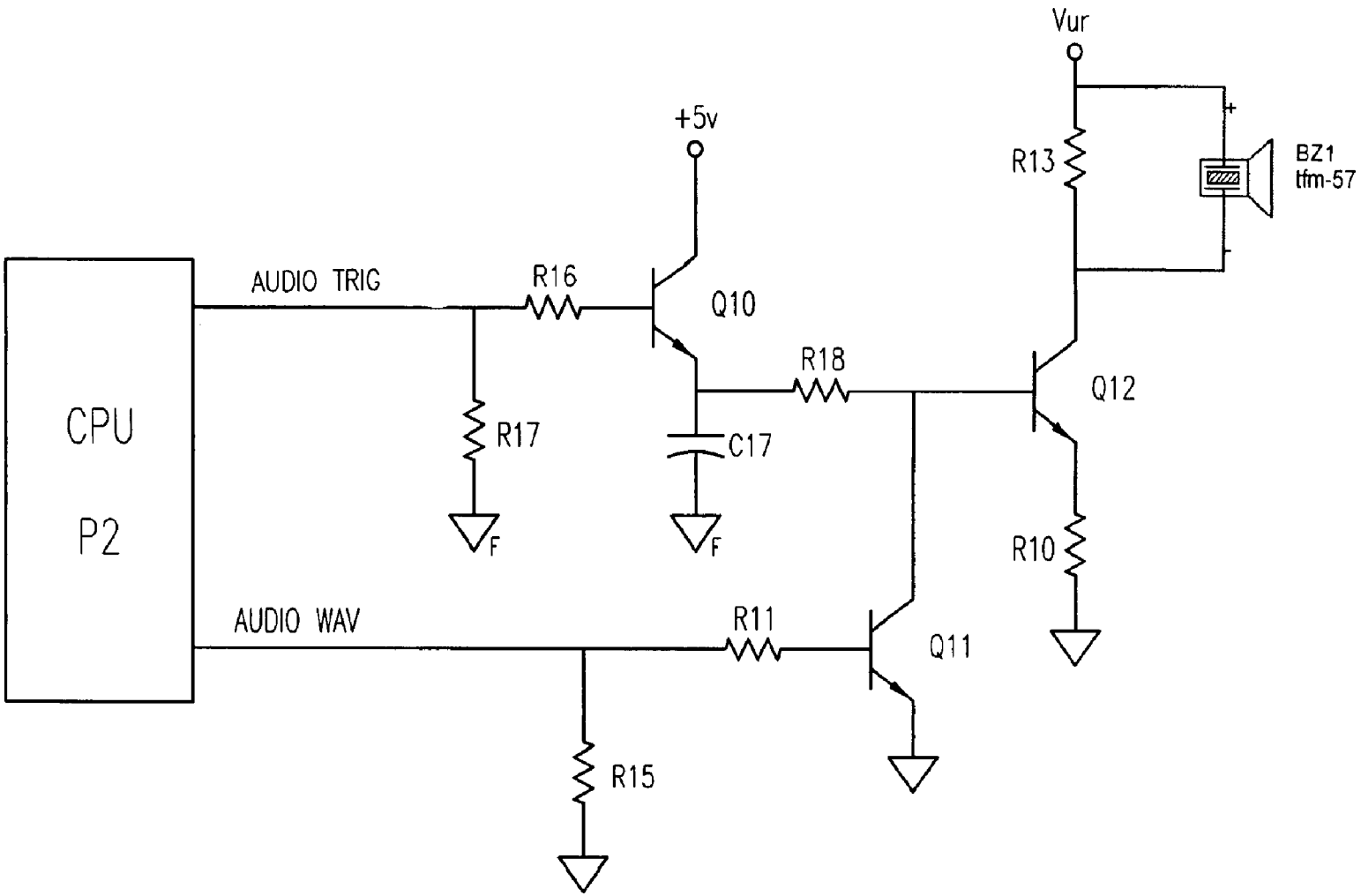
FIG. 3 shows a schematic of another hardware circuit for implementing another embodiment of the invention.

FIG. 3 shows an additional embodiment of the invention for generating a chime tone. The circuit in FIG. 3 works in a similar manner as the circuit in FIG. 2, described above, except that the attack portion of the chime circuit has been removed (e.g., see FIG. 2: resistor R5).

In a current embodiment of the circuit of FIG. 3, the circuit components take on the values or types given in the following table:

TABLE 2

| Component | Value |
|---|---|
| R11, R15, R16, R17 | 10 kΩ |
| R18 | 4.7 kΩ |
| R13 | 1.2 kΩ |
| R10 | 100Ω |
| Q10, Q11, Q12 | MMBT4401 |
| C17 | 1 μF |
| BZ1 | TFM-57 |

Finally, the computer program listing appendix to this application contains two ASCII modules of "C" code for generating the chime melodies using a general purpose or dedicated microprocessor P2. For example, the program of the computer program listing can be compiled with a HiTech C Compiler, and a PIC18F452 processor can be used with one of the circuits of FIG. 2 or 3, described above. The software code, described in more detail below, when executed by the processor, then provides the chime circuit inputs AUDIO_WAV and AUDIO_TRIG, described for FIGS. 2 and 3, from processor outputs in a manner adapted to the chosen processor.

Referring again to FIG. 4, the software modules are stored in the memory 3 for retrieval by the processor 2. The memory 3 also stores the data discussed below for generating the musical notes of the notification melody.

The first software module is for providing functions to access a standard chime circuit. This module executes on a processor, providing a PWM output for the waveform generation and a standard I/O line output to trigger and hold the note, using one of the circuits shown above (or another equivalent circuit).

The module has a function that starts the chime. This function accepts: ChimeRequest, a Chime_t enumerated value that corresponds to the chime to be played. The module also has a function that is called on a period based on the timebase of the current chime being played. This function handles toggling all note signals.

The second module has tables with settings for each individual note based on an 8 MHz system clock. These tables have note and duration data for each "song" melody or tone that can be played. The first character of this array represents a time base which this chime will be played at. It is a multiple of the schedule tick. The 0xFF at the end of the array represents the end of the chime. Care should be taken that no other character in the array matches this number or the chime will end prematurely. In between these characters are the series of note data for the song. Each note consists of a 5 bit note value which refers to a position in the NoteTable array, and a 3 bit value which represents the duration of that note. The duration is the number of times through the scheduler loop to hold that note, and 1 is added to it automatically. Rests are called by referencing a 0 note value.

Figure 5:
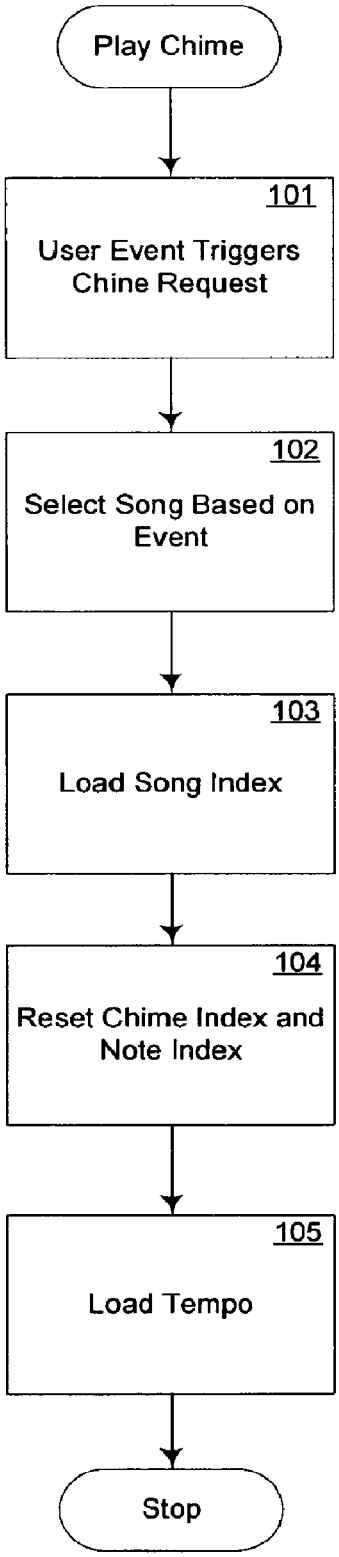
FIG. 5 is a high-level Flow Chart showing the song-playing operation of the software for driving one of the circuits of FIGS. 2 and 3.

FIG. 5 is a flow chart showing a high-level operation of the device software shown in the appendix. To play the chime, an event being monitored by the processor triggers the software 101, and a song melody is selected 102 from the device memory according to the triggering event. The song index is loaded 103, the chime index and note index are reset 104 according to the loaded song, and the tempo of the song is loaded 105. Thus is the song melody played note by note as described in the flow chart of FIG. 6.

The parameters (song index including chime and note index) called by the software routine to play the song melody are stored in the device memory, which could be RAM, ROM, EEPROM, a hard drive, or another memory device or combination of devices, for example. Thus, a plurality of events can each be associated with a unique song melody, with the software routine calling the song parameters (i.e., the tempo of the song, and the frequency and duration of each note of the song) according to the triggering event.

Figure 6:
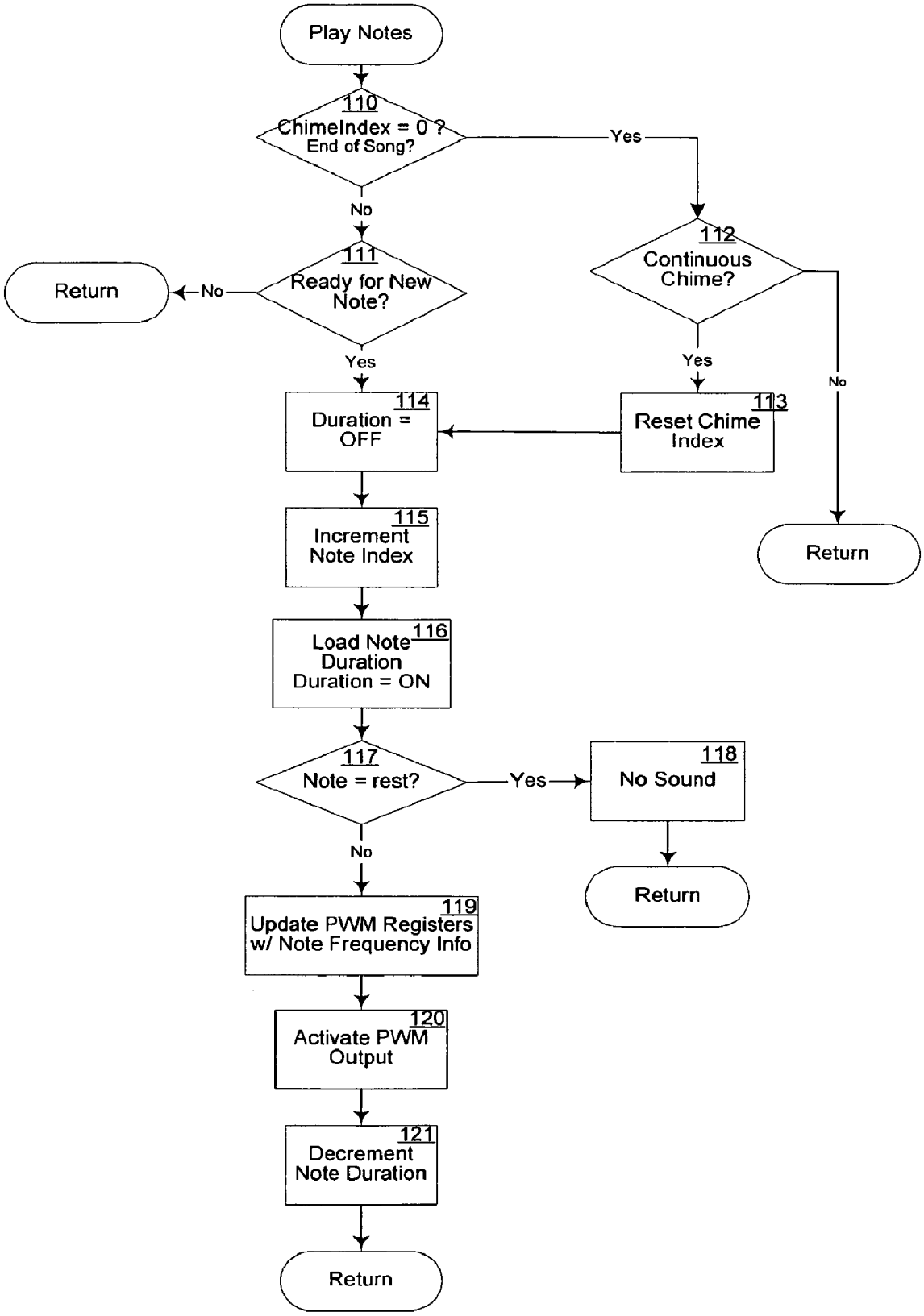
FIG. 6 is another Flow Chart showing the note-playing operation of the software for playing notes of the song.

FIG. 6 is a flow chart showing the routine for playing the notes of the triggered song. The routine first checks to be sure that the song melody is not at an end 110. If the song is at the end, the routine checks 112 to see if the chime has been set to continuous, if so the chime index is reset 113 and the routine continues at 114 (see below). If not, the routine returns to its start.

If the song melody is not at the end, the routine checks to see if it is ready for a new note 111. If not, the routine returns to its start.

When ready for a new note, the routine sets the duration to OFF 114, increments the note index 115, loads the note duration and sets duration to ON 116, and checks to see if the note is a rest. If the note is a rest, no sound is played, and the routine returns to its start.

If the note is not a rest, the PWM registers are updated 119 with note frequency information, the PWM output is then activated 120, and note duration is decremented 121 and the routine returns to its start.

This routine is executed by the processor for each note of the song, and is called at a rate of 5 ms times the loaded tempo value. The tempo value can thus be used to control the melody tempo.

Referring again to FIG. 4, the device generally operates as follows. The microprocessor 2 detects a status of the appliance via the input device 4. Such a status might be a keyed input from a user, such as a user choosing a bake or broil cycle on an oven by using an input key or button, for example. Furthermore, again using an oven example, the status could be the end of a baking or cleaning cycle, or the reaching of a baking temperature, or the expiration of a timer, for example.

The processor executes the tone generation circuit in response to the status detection to play a melody associated with the detected status, to notify the user of the detected status of the device.

A plurality of different melodies can be stored (i.e., via the tone data stored in memory, as discussed above) with each melody being associated with a different status condition, for example. Alternatively, melody tempos might also be varied based on various status conditions. In this manner, the user can be notified of a specific detected status condition based on the melody played by the notification device.

In this manner, the user of the appliance is notified of various status conditions with one or more pleasing, musical melodies, rather than a harsh buzzer or bell.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

CHIME CODE MODULE 1:

```
/*****************************************************************************
******
 *
 *   Filename: C:\Source\Backlite\Chime.c
 *
 *   Author: Bobby Hayes
 *
 *   Modified by: John Rudolph
 *
 *   Copyright (c) 2003, Electrolux Home Products
 *
 *   Description: The purpose of this module is to provide functions to access
 *     the Electrolux standard chime circuit.   This module uses a PWM output for
 *     the waveform generation and a standard I/O line to trigger and hold the note.
 *
 *
~~~
```

-continued

CHIME CODE MODULE 1:

```
*   History: Created on 05/03/2003
*
*   Compiled Using: Hi-Tech C Compiler PICC v8.01 PL3 and MPLab v6.30
*
*   Version 1.00 Original Software
*               05/15/2003 - Chime module created
*
*******************************************************************************
*****/
#define __CHIME__
#include <pic.h>
#include "global.h"
#include "chime.h"
#define NOTE__ON     PORTC |= 0x02        //0x01 - controls for the I/O line that
#define NOTE__OFF    PORTC &= 0xFD        //0xFE - turns the note on/off
unsigned char ChimeTimerIndex;            //timer index value returned by the scheduler
unsigned char NoteCount;                  //note duration
unsigned char ChimeIndex;                 //current position in the note table array
unsigned char tempo=10;          //multiplyer for chime task timebase
const unsigned char *CurrentChime;       //current chime being played
extern unsigned char continuous__chime;
void PlayNotes(void);
void PlayChime(unsigned char ChimeRequest);
/*******************************************************************************
***********
*                    void PlayChime(unsigned char ChimeRequest)
*
* PARAMETERS: none
*
* DESCRIPTION: The following function starts a chime. This function accepts: ChimeRequest,
*          a Chime__t enumerated value that corresponds to the chime to be played.
*
* RETURNS: none
*
*/
void PlayChime(unsigned char ChimeRequest)
{
    /* Load the current chime with the chime requested.          */
    switch(ChimeRequest)
    {
        case chm__INTRO:
            CurrentChime = Chime__Intro;
            break;
        case chm__ACCEPT:
            CurrentChime = Chime__Accept;
            break;
                case chm__CLEAN__END__CYCLE:
            CurrentChime = Chime__CleanEndCycle;
            break;
                case chm__END__CYCLE:
            CurrentChime = Chime__EndCycle;
            break;
                case chm__FAILURE:
            CurrentChime = Chime__Failure;
            break;
                case chm__PREHEAT:
            CurrentChime = Chime__Preheat;
            break;
                case chm__TIMER__END__CYCLE:
            CurrentChime = Chime__TimerEndCycle;
            break;
                case chm__DOOR__OPEN:
            CurrentChime = Chime__DoorOpen;
            break;
                case chm__INVALID:
            CurrentChime = Chime__Invalid;
            break;
        default:
            CurrentChime = Chime__Intro;
    }
    tempo=CurrentChime[0];
    /* Reset song counters                          */
```

-continued

CHIME CODE MODULE 1:

```
    ChimeIndex = 0;
    NoteCount = 0;
}
/*******************************************************************************
***********
*               void PlayNotes(void)
*
* PARAMETERS: none
*
* DESCRIPTION: The following function is called on a period based on the timebase of the
*         current chime being played.    This function handles toggling all note signals.
*         The following function is called on a period based on the timebase of the
*         current chime being played.    This function handles toggling all note signals.
*
* RETURNS: none
*
*/
void PlayNotes(void)
{
    unsigned char duty__1__and__prescalar;
    // Check to see if the end of the chime has been reached
    if(CurrentChime[(ChimeIndex + 1)] == 0xFF)
    {
        if(continuous__chime==ON)
                ChimeIndex=0;                   //reset index for continuous chimes
        return;             //if not continuous then stop the timer/chime
    }
    else
    {
        //If the end has not yet been reached, check to see if the note count
        //has expired.    ie, you are ready for a new note.
        if(!NoteCount)
        {
            ChimeIndex++;                       //increase the chime index
            //Set the new note count to the duration in the chime data array
            NoteCount = (CurrentChime[ChimeIndex] >> 5) + 1;
            // Check to see if the next note is a rest
            if((CurrentChime[ChimeIndex] & 0x1F) == 0)
            {
                NOTE__OFF;                      //turn off the note for "rest"
            }
            else
            {
                //Update all PWM registers w/the new note info
                PR2 = NoteTable[ (CurrentChime[ChimeIndex] & 0x1F) ][0];
                duty__1__and__prescalar = NoteTable[ (CurrentChime[ChimeIndex] & 0x1F) ][2];
                CCP1CON = (duty__1__and__prescalar & 0xF0) |0x0C;
                CCPR1L = NoteTable[ (CurrentChime[ChimeIndex] & 0x1F) ][1];
                T2CON = duty__1__and__prescalar & 0x0F;
                NOTE ON;                        //Now turn on the note
            }
        }
        NoteCount--;                            //Decrease the note counter
    }
}
/*******************************************************************************
*******/
/*******************************************************************************
*******/
//eof
```

CHIME CODE MODULE 2:

```
/*******************************************************************************
******
 *
 *   Filename:      C:\Source\Backlite\chime.h
 *
 *   Author:        Bobby Hayes
 *   Modified by:   John Rudolph
```

-continued

CHIME CODE MODULE 2:

```
 *
 *   Copyright (c) 2003, Electrolux Home Products
 *
 *   Description: Chime module header file
 *
 *
~~~
```

-continued

CHIME CODE MODULE 2:

```
// the series of note data for the song. Each note consists of a 5 bit note
// value which refers to a position in the NoteTable array, and a 3 bit value
// which represents the duration of that note. The duration is the number of
// times through the scheduler loop to hold that note, and 1 is added to it
// automatically. Rests are called by referencing a 0 note value.
//
// Enter notes this way:
//    X   | ((Y – 1) << 5)    Where X = the note value and Y = the duration
const unsigned char Chime_Intro[ ]= { 10,
                                      20 | ((6 – 1) << 5),
                                      20 | ((6 – 1) << 5),
                                                  0 | ((8–1) << 5),
                                                  0xFF };
const unsigned char Chime_Accept[ ]= { 10,
                                                  31 | ((2 – 1) << 5),
                                                  0 | ((8 – 1) << 5),
                                                  0xFF };
const unsigned char Chime CleanEndCycle[ ]= {10,
                                                  31 | ((6 – 1) << 5),
                                                  0 | ((6 – 1) << 5),
                                                  0 | ((6 – 1) << 5),
                                                  31 | ((6 – 1) << 5),
                                                  0 | ((6 – 1) << 5),
                                                  0 | ((6 – 1) << 5),
                                                  31 | ((6 – 1) << 5),
                                                  0 | ((6 – 1) << 5),
                                                  0 | ((6 – 1) << 5),
                                                  0xFF };
const unsigned char Chime_EndCycle[ ]= { 10,
                                                  31 | ((6 – 1) << 5),
                                                  31 | ((4 – 1) << 5),
                                                  0 | ((4 – 1) << 5),
                                                  0 | ((4 – 1) << 5),
                                                  31 | ((6 – 1) << 5),
                                                  31 | ((4 – 1) << 5),
                                                  0 | ((4 – 1) << 5),
                                                  0 | ((4 – 1) << 5),
                                                  31 | ((6 – 1) << 5),
                                                  31 | ((4 – 1) << 5),
                                                  0 | ((4 – 1) << 5),
                                                  0 | ((4 – 1) << 5),
                                                  0xFF };
const unsigned char Chime_Failure[ ]= { 10,
                                                  29 | ((6 – 1) << 5),
                                                  0 | ((2 – 1) << 5),
                                                  0xFF };
const unsigned char Chime_Preheat[ ]= { 10,
                                                  31 | ((6 – 1) << 5),
                                                  31 | ((6 – 1) << 5),
                                                  31 | ((6 – 1) << 5),
                                                  31 | ((6 – 1) << 5),
                                                  0 | ((2 – 1) << 5),
                                                  0xFF };
const unsigned char Chime TimerEndCycle[ ]= {10,
                                                  31 | ((6 – 1) << 5),
                                                  31 | ((6 – 1) << 5),
                                                  0 | ((6 – 1) << 5),
                                                  31 | ((6 – 1) << 5),
                                                  31 | ((6 – 1) << 5),
                                                  0 | ((6 – 1) << 5),
                                                  31 | ((6 – 1) << 5),
                                                  31 | ((6 – 1) << 5),
                                                  0 | ((6 – 1) << 5),
                                                  0xFF };
const unsigned char Chime_DoorOpen[ ]= { 10,
                                                  31 | ((2 – 1) << 5),
                                                  0 | ((4 – 1) << 5),
                                                  31 | ((2 – 1) << 5),
                                                  0 | ((4 – 1) << 5),
                                                  31 | ((2 – 1) << 5),
                                                  0 | ((4 – 1) << 5),
                                                  0xFF };
const unsigned char Chime_Invalid[ ]= { 10,
                                                  31 | ((2 – 1) << 5),
                                                  0 | ((4 – 1) << 5),
                                                  31 | ((2 – 1) << 5),
                                                  0 | ((4 – 1) << 5),
```

-continued

CHIME CODE MODULE 2:

```
                                                    31 | ((2 – 1) << 5),
                                                    0 | ((4 – 1) << 5),
                                                    0xFF };
/*****************************************************************************
*******/
/*****************************************************************************
*******/
//eof
```

What is claimed is:

1. A notification device for an appliance having a plurality of status conditions, said device comprising:

a memory for storing a program and also for storing a plurality of melody data each representing one of a plurality of melodies, wherein each of the plurality of status conditions is associated with one of said plurality of melodies;

a microprocessor for monitoring each of the plurality of status conditions, wherein, upon detection of one of the status conditions, said microprocessor executes said program utilizing the one of said plurality of melody data associated with the one of the status conditions for generating an output signal according to said one of said plurality of melody data; and an electronic circuit for inputting said output signal and outputting a musical melody signal, said electronic circuit including an output transducer connected to said electronic circuit for inputting said musical melody signal for producing the melody associated with the one of the status conditions to notify a user of the one of the status conditions, wherein said output signal includes:

a first output signal for providing an oscillating signal to drive said electronic circuit to produce the musical notes of said melody; and a second output signal providing a trigger signal to trigger and hold each of said musical notes.

2. The notification device of claim 1, wherein said electronic circuit comprises:

an RC circuit for controlling the decay and attack times of said musical notes; and a transistor connected to said second output signal and also connected to said RC circuit for charging or discharging said RC circuit based on said second output signal.

3. The notification device of claim 2, wherein said circuit further comprises a second transistor connected to said first output signal and connected to both said RC circuit and a third transistor, said second transistor for providing a frequency signal, with decay and attack times as set by the RC circuit, to said third transistor, and wherein said third transistor is connected to said transducer for amplifying said frequency signal for driving said transducer.

4. A notification device for an appliance having a plurality of status conditions, said device comprising:

a memory for storing a program and also for storing a plurality of melody data each representing one of a plurality of melodies, wherein each of the plurality of status conditions is associated with one of said plurality of melodies;

a microprocessor for monitoring each of said plurality of status conditions, wherein, upon detection of one of said status conditions, said microprocessor executes said program utilizing the one of said plurality of melody data associated with the one of said status conditions for generating a first output signal and a second output signal according to said one of said plurality of melody data; and an electronic circuit for inputting said first output signal and inputting said second output signal and for outputting a musical melody signal, said electronic circuit including an output transducer connected to said electronic circuit for inputting said musical melody signal for producing the melody associated with the one of said status conditions to notify a user of the one of said status conditions, and wherein said first output signal provides an oscillating signal to drive said electronic circuit to control a frequency of a musical note in said melody; and wherein said second output signal provides a trigger signal to trigger and hold said note of said melody.

5. The notification device of claim 4, wherein said electronic circuit comprises:

an RC circuit for controlling the decay and attack times of said plurality of notes; and a transistor connected to said second output signal and also connected to said RC circuit for charging or discharging said RC circuit based on said second output signal.

6. The notification device of claim 5, wherein said circuit further comprises a second transistor connected to said first output signal and connected to both said RC circuit and a third transistor, said second transistor for providing a frequency signal, with decay and attack times as set by the RC circuit, to said third transistor, and wherein said third transistor is connected to said transducer for amplifying said frequency signal for driving said transducer.

7. An appliance system comprising:

a consumer appliance; and a notification device including:

a memory for storing a program and also for storing a plurality of melody data each representing one of a plurality of melodies, wherein each of the plurality of status conditions is associated with one of said plurality of melodies;

a microprocessor for monitoring each of said plurality of status conditions, wherein, upon detection of one of said status conditions, said microprocessor executes said program utilizing the one of said plurality of melody data associated with the one of said status conditions for generating a first output signal and a second output signal according to said one of said plurality of melody data; and an electronic circuit for inputting said first output signal and inputting said second output signal and for outputting a musical melody signal, said electronic circuit including an output transducer connected to said electronic circuit for inputting said musical melody signal for producing the melody associated with the one of said status conditions to notify a user of the one of said status conditions, and wherein said first output signal provides an oscillating signal to drive said electronic circuit to control a frequency of a musical note in said melody; and wherein said second output signal provides a trigger signal to trigger and hold said note of said melody.

8. The notification device of claim 7, wherein said electronic circuit comprises:

an RC circuit for controlling the decay and attack times of said plurality of notes;

a transistor connected to said second output signal and also connected to said RC circuit for charging or discharging said RC circuit based on said second output signal a third transistor; and a second transistor connected to said first output signal and connected to both said RC circuit and said third transistor, said second transistor for providing a frequency signal, with decay and attack times as set by the RC circuit, to said third transistor, and wherein said third transistor is connected to said transducer for amplifying said frequency signal for driving said transducer.

9. A method for notifying a user of a status of an appliance comprising the steps of:

storing a program in a memory;

using a microprocessor to detect a status condition of the appliance;

executing said program on the microprocessor, said executing including the steps of:

retrieving melody data associated with the detected status condition;

generating a first output signal of the microprocessor based on said retrieved melody data to provide an oscillating signal to a first output;

generating a second output signal of the microprocessor based on said retrieved melody data to provide a trigger signal to a second output;

providing said first output to a first input of an electronic circuit;

providing said second output to a second input of said electronic circuit; and using an output transducer of said electronic circuit to generate a musical melody based on said retrieved melody data for notifying the user of the detected status of the appliance.

10. The notification method of claim 9, wherein said electronic circuit comprises:

an RC circuit for controlling the decay and attack times of said plurality of notes; and a transistor connected to said second output signal and also connected to said RC circuit for charging or discharging said RC circuit based on said second output signal.

11. The notification device of claim 8, wherein said circuit further comprises a second transistor connected to said first output signal and connected to both said RC circuit and a third transistor, said second transistor for providing a frequency signal, with decay and attack times as set by the RC circuit, to said third transistor, and wherein said third transistor is connected to said transducer for amplifying said frequency signal for driving said transducer.

* * * * *